US011753776B2

(12) United States Patent
Siao

(10) Patent No.: US 11,753,776 B2
(45) Date of Patent: Sep. 12, 2023

(54) INTERLOCKING PAVING BRICK ASSEMBLY

(71) Applicant: JING SI PURELAND CO., LTD., Taipei (TW)

(72) Inventor: Marshall Q. Siao, Xincheng Township, Hualien County (TW)

(73) Assignee: JING SI PURELAND CO., LTD., Taipei (TW)

( * ) Notice: Subject to any disclaimer, the term of this patent is extended or adjusted under 35 U.S.C. 154(b) by 206 days.

(21) Appl. No.: 17/243,605

(22) Filed: Apr. 29, 2021

(65) Prior Publication Data

US 2022/0064871 A1 Mar. 3, 2022

(30) Foreign Application Priority Data

Sep. 2, 2020 (TW) ..... 109130106

(51) Int. Cl.
*E01C 5/04* (2006.01)
*E01C 5/00* (2006.01)
*E01C 11/24* (2006.01)

(52) U.S. Cl.
CPC ..... *E01C 5/04* (2013.01); *E01C 5/003* (2013.01); *E01C 11/24* (2013.01); *E01C 2201/12* (2013.01); *E01C 2201/14* (2013.01)

(58) Field of Classification Search
CPC . E01C 5/003; E01C 5/04; E01C 11/24; E01C 2201/12; E01C 2201/14
USPC ..... 404/34–46
See application file for complete search history.

(56) References Cited

U.S. PATENT DOCUMENTS 1,417,010 A * 5/1922 Wright ..... E01C 5/00 404/34
1,430,392 A * 9/1922 Lukens ..... B28B 1/52 106/164.6
4,030,729 A * 6/1977 Nathaniel ..... E01C 13/107 472/90
RE32,663 E * 5/1988 Atkinson ..... E02B 3/14 446/124

(Continued)

FOREIGN PATENT DOCUMENTS

CN 101313114 A 11/2008
CN 201850738 U 6/2011

(Continued)

*Primary Examiner* — Raymond W Addie
(74) *Attorney, Agent, or Firm* — ScienBiziP, P.C.

(57) ABSTRACT

An interlocking paving brick assembly comprises a protruding brick (10) and a recessing brick (20). The protruding brick is a block and comprises a first top portion (11) and four first sidewalls (12). Every angle between each of the first sidewall and the first top portions is a right angle, each of the first sidewall comprises a tenon structure (13). The recessing brick is a block, including a second top portion (21) and four second sidewalls (22). Every angle between each of the second sidewall and the second top portions is a right angle, and each of the second sidewall comprises a mortise structure (23). The tenon structure of the protruding brick and the mortise structure of the recessing brick is structurally complementary to each other, so the protruding brick and the recessing brick can be connected by the tenon structure and the mortise structure to form the interlocking paving brick assembly.

13 Claims, 16 Drawing Sheets

(56) References Cited

U.S. PATENT DOCUMENTS

| | | | | | |
|---|---|---|---|---|---|
| 5,280,691 | A * | 1/1994 | Rundmund | E04F 13/142 | 52/390 |
| 5,281,048 | A * | 1/1994 | Hagenah | B28B 13/022 | 404/34 |
| 5,971,655 | A * | 10/1999 | Shirakawa | E01C 5/20 | 404/34 |
| 6,640,513 | B2 * | 11/2003 | Ku | E04F 15/02 | 52/177 |
| 7,704,011 | B2 * | 4/2010 | Marshall | E03F 1/005 | 404/34 |
| 2004/0255540 | A1 * | 12/2004 | Wang | E04F 15/10 | 52/582.1 |
| 2005/0193679 | A1 | 9/2005 | Langsdorff et al. | | |
| 2012/0020730 | A1 * | 1/2012 | Chow | E01C 15/00 | 404/34 |
| 2013/0279979 | A1 * | 10/2013 | Pollack | E04F 13/14 | 404/73 |
| 2014/0270946 | A1 * | 9/2014 | Bradsen | E01C 5/06 | 404/40 |

FOREIGN PATENT DOCUMENTS

| | | | | | |
|---|---|---|---|---|---|
| CN | 105756320 | A | | 7/2016 | |
| CN | 205421832 | U | | 8/2016 | |
| CN | 106189300 | A | | 12/2016 | |
| CN | 206110557 | U | | 4/2017 | |
| CN | 206170743 | U | | 5/2017 | |
| CN | 207646690 | U | | 7/2018 | |
| CN | 108752686 | A | | 11/2018 | |
| CN | 209426315 | U | | 9/2019 | |
| CN | 110552268 | A | | 12/2019 | |
| CN | 110750843 | A | | 2/2020 | |
| CN | 210049533 | U | | 2/2020 | |
| EP | 3569763 | A1 | | 11/2019 | |
| JP | S55-132801 | A | | 10/1980 | |
| JP | WO 89/03453 | | * | 6/1988 | E01C 5/22 |
| JP | 2004-60263 | A | | 2/2004 | |
| JP | 2009-274780 | A | | 11/2009 | |
| JP | 2019-214929 | A | | 12/2019 | |
| TW | 201947087 | A | | 12/2019 | |
| TW | I699271 | B | | 7/2020 | |
| WO | 2004038104 | A1 | | 5/2004 | |

* cited by examiner

INTERLOCKING PAVING BRICK ASSEMBLY

CROSS-REFERENCE TO RELATED APPLICATIONS

This application claims the benefit of Taiwan Patent Application No. 109130106 filed on Sep. 2, 2020, which is hereby incorporated by reference herein and made a part of specification.

FIELD

The present disclosure generally relates to an interlocking paving brick assembly and a method of assembly thereof. More particularly, the present disclosure relates to a novel structure of the interlocking paving brick assembly that facilitate fast and convenient assembly thereof.

BACKGROUND

The laying of paving brick not only allows people to walk, but also allows vehicles to pass. The design of a traditional paving brick leads to a complicated laying process which comprises multiple steps such as base layer laying, base layer leveling, floor tile laying, floor tile caulking, and tile surface cleaning. Therefore, traditional paving brick is expansive to install, and the installation quality is hard to guarantee. At the same time, there are problems such as poor drainage and poor soil and water conservation.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure.

Moreover, in the drawings, like reference numerals designate corresponding parts throughout the several views.

DETAILED DESCRIPTION

Figure 1:
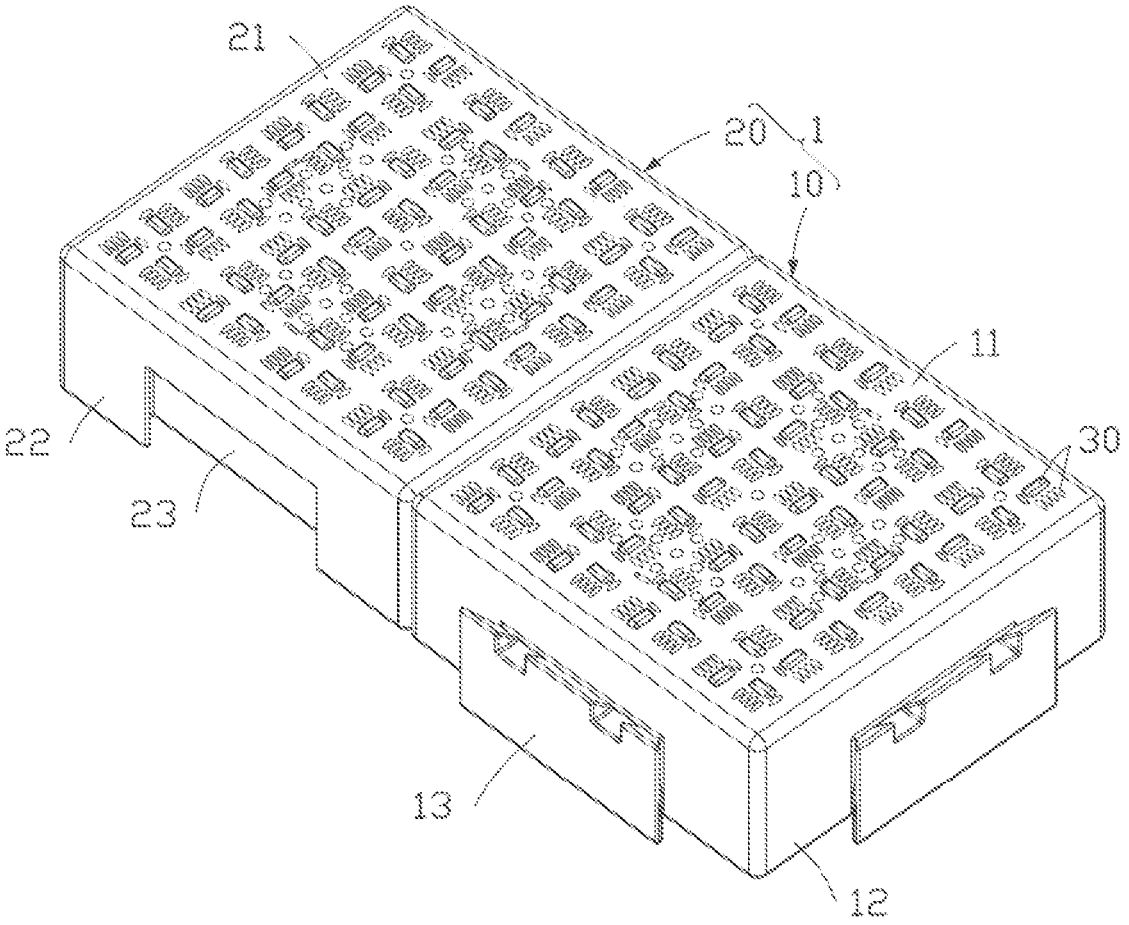
FIG. 1 illustrates an isometric view of an interlocking paving brick assembly according to one embodiment of the present disclosure.

It will be appreciated that for simplicity and clarity of illustration, where appropriate, reference numerals have been repeated among the different figures to indicate corresponding or analogous elements. In addition, numerous specific details are set forth to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

In regard to the term "couple" or "coupling" used throughout the disclosure, it can imply both direct and indirect connection. In regard to the term "comprise", it is defined as including but not limited to, thereby clearly indicating an open relationship of the described combinations, groups, and equivalents. In regard to the term "substantially", it is defined as having a deviation of plus/minus 2% from a measurement. In regard to the term "substantially parallel", it is defined as visually being about equidistant without assisting equipment (e.g. magnifier, microscope, measuring instrument). In regard to the term "substantially perpendicular", it is defined as visually being about right angle without assisting equipment (e.g. magnifier, microscope, measuring instrument). In regard to the term "substantially coplanar", it is defined as visually being about in the same plane without assisting equipment (e.g. magnifier, microscope, measuring instrument).

According to one embodiment of the present disclosure, FIG. 1 illustrates an interlocking paving brick assembly 1. The interlocking paving brick assembly 1 comprises a protruding brick 10 and a recessing brick 20. The protruding brick 10 is a block comprising a top portion 11 and four sidewalls 12 coupling to the top portions 11, and each angle between each of the sidewalls 12 and the top portion 11 is about 90 degrees. In addition, each of the sidewalls 12 comprises a tenon structure 13. The recessing brick 20 comprises a top portion 21 and four sidewalls 22 coupling to the top portions 21, and each angle between each of the sidewalls 22 and the top portion 21 is about 90 degrees. In addition, each of the sidewalls 12 comprises a mortise structure 23. The tenon structure 13 of the protruding brick 10 and the mortise structure 23 of the recessing brick 20 are structurally complementary to each other, so the protruding brick 10 can interlock with the recessing brick 20 via coupling of the tenon structure 13 and the mortise structure 23. Therefore, the protruding brick 10 and the recessing brick 20 can fit to each other closely and tightly in order to form the interlocking paving brick assembly 1. The interlocking paving brick assembly 1 further comprises a plurality of top anti-slip portion 30 arranged on the top surface of the protruding brick 10 and the recessing brick 20, thereby increasing friction between the interlocking paving brick assembly 1 and one that it bears on top thereof.

Figure 2:
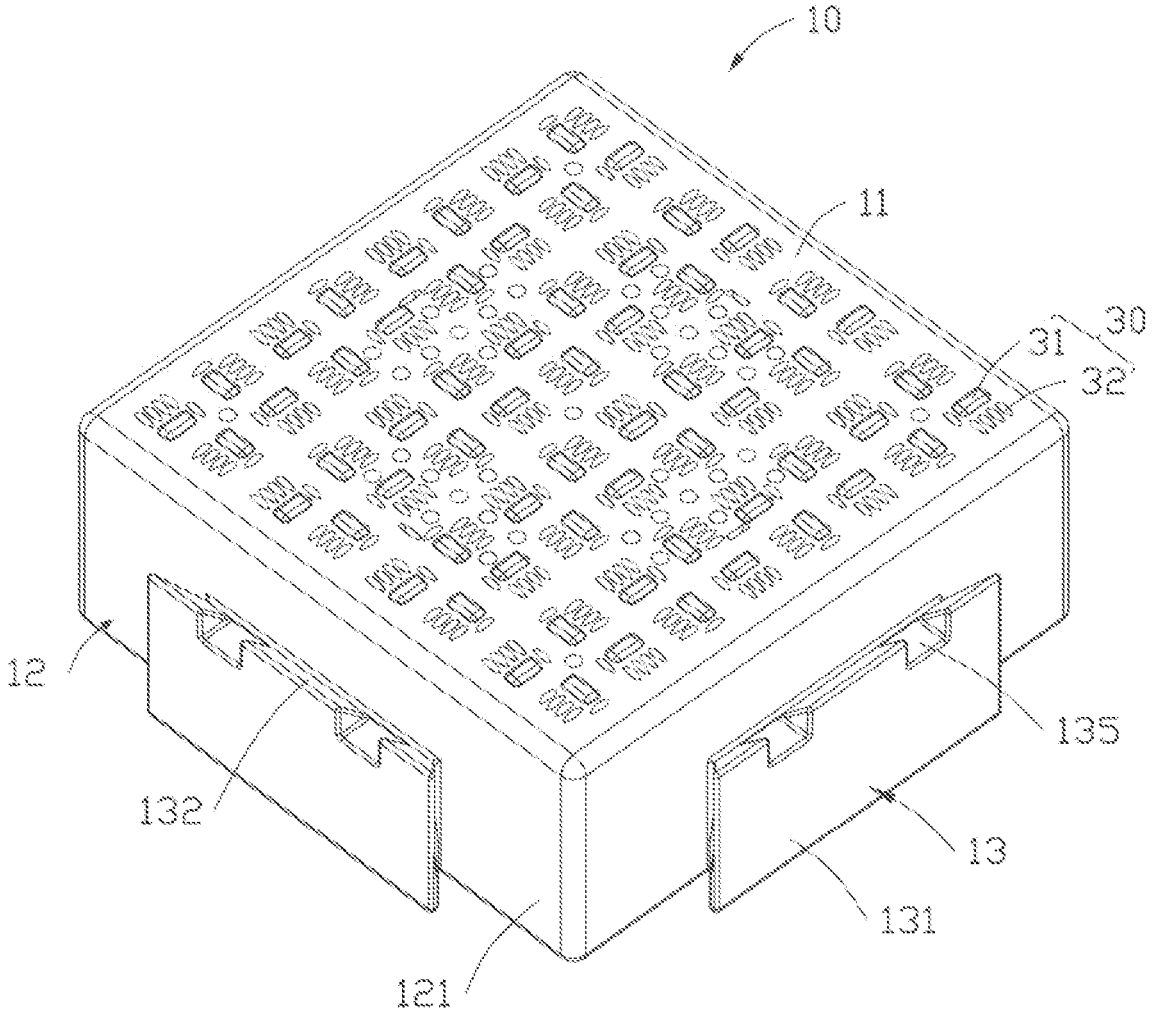
FIG. 2 illustrates an isometric view of a protruding brick according to one embodiment of the present disclosure.
Figure 3:
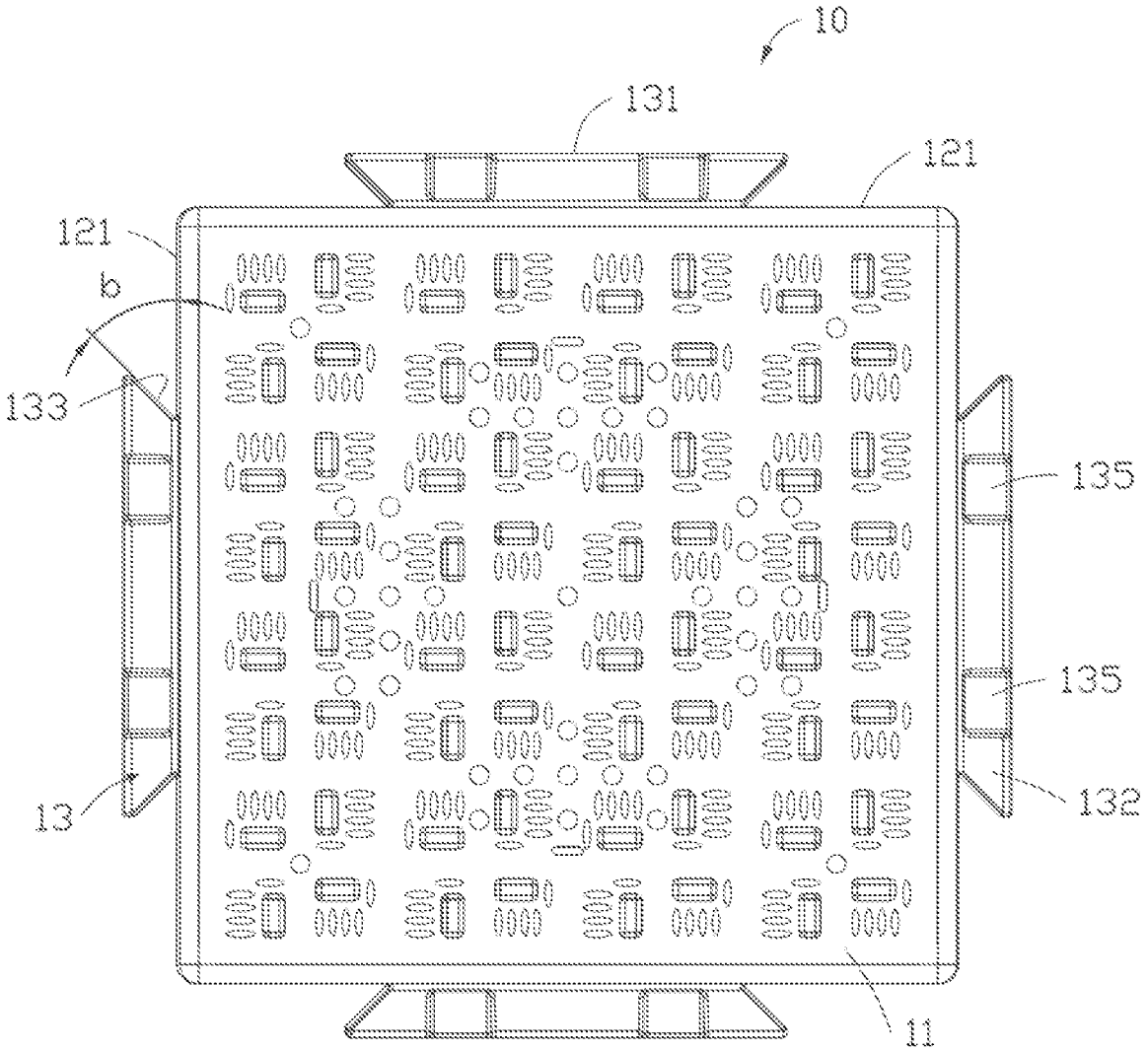
FIG. 3 illustrates a top view of the protruding brick according to one embodiment of the present disclosure.
Figure 4:
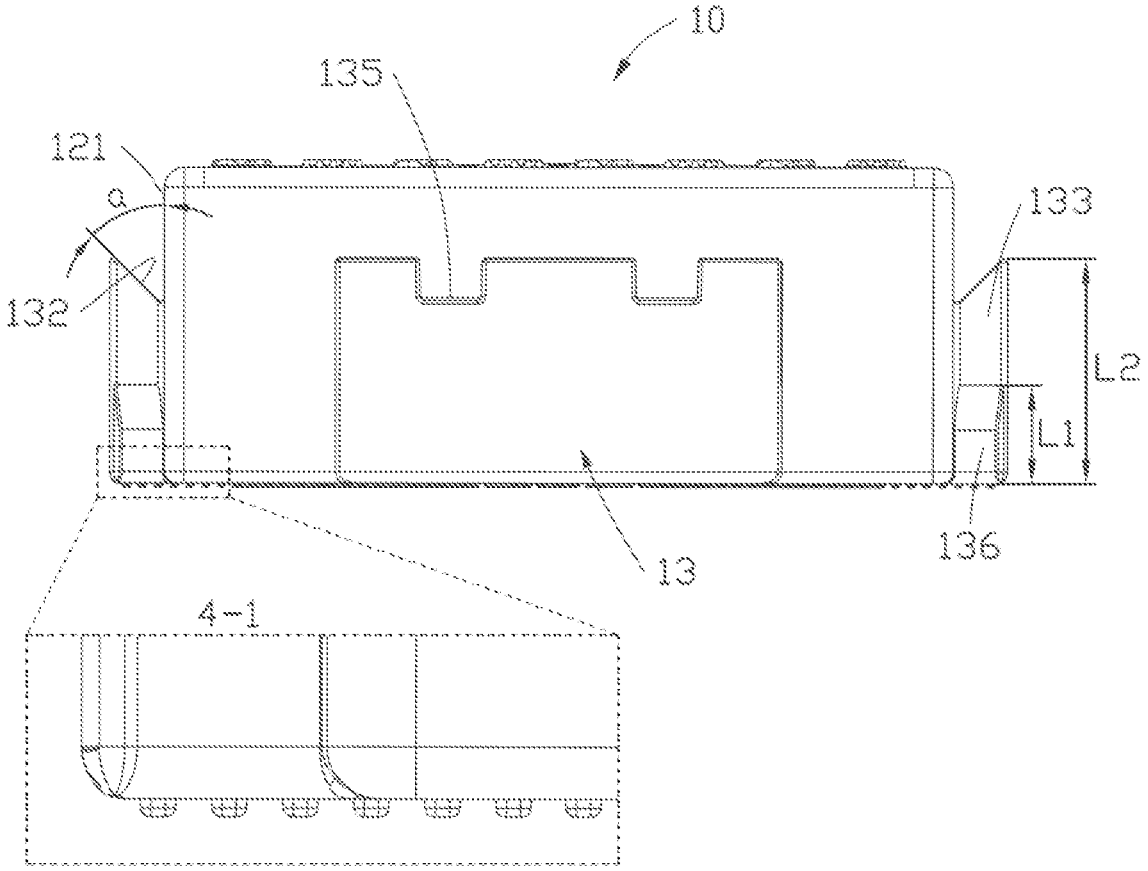
FIG. 4 illustrates a side view of the protruding brick according to one embodiment of the present disclosure.
Figure 5:
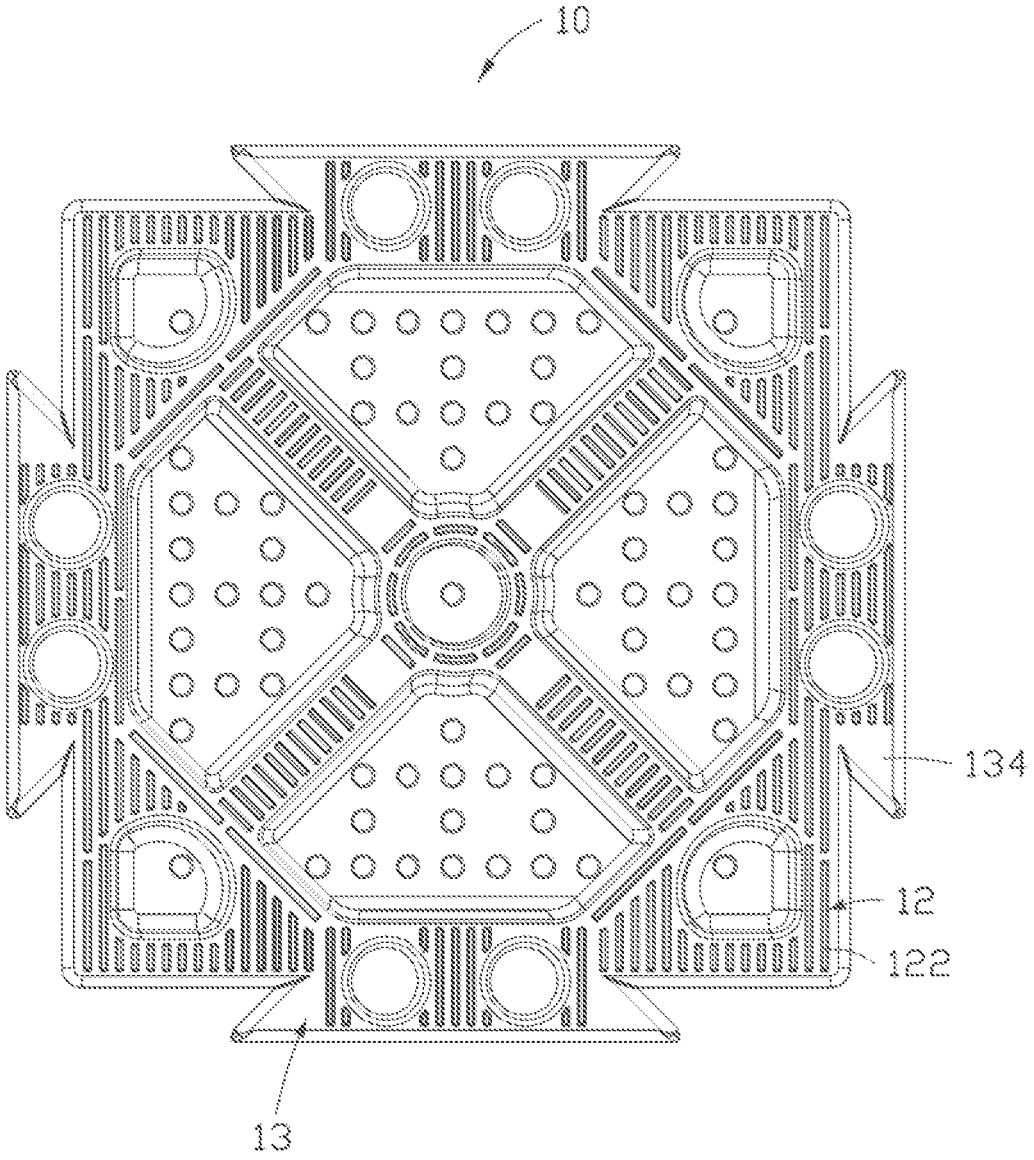
FIG. 5 illustrates a bottom view of the protruding brick according to one embodiment of the present disclosure.
Figure 6:
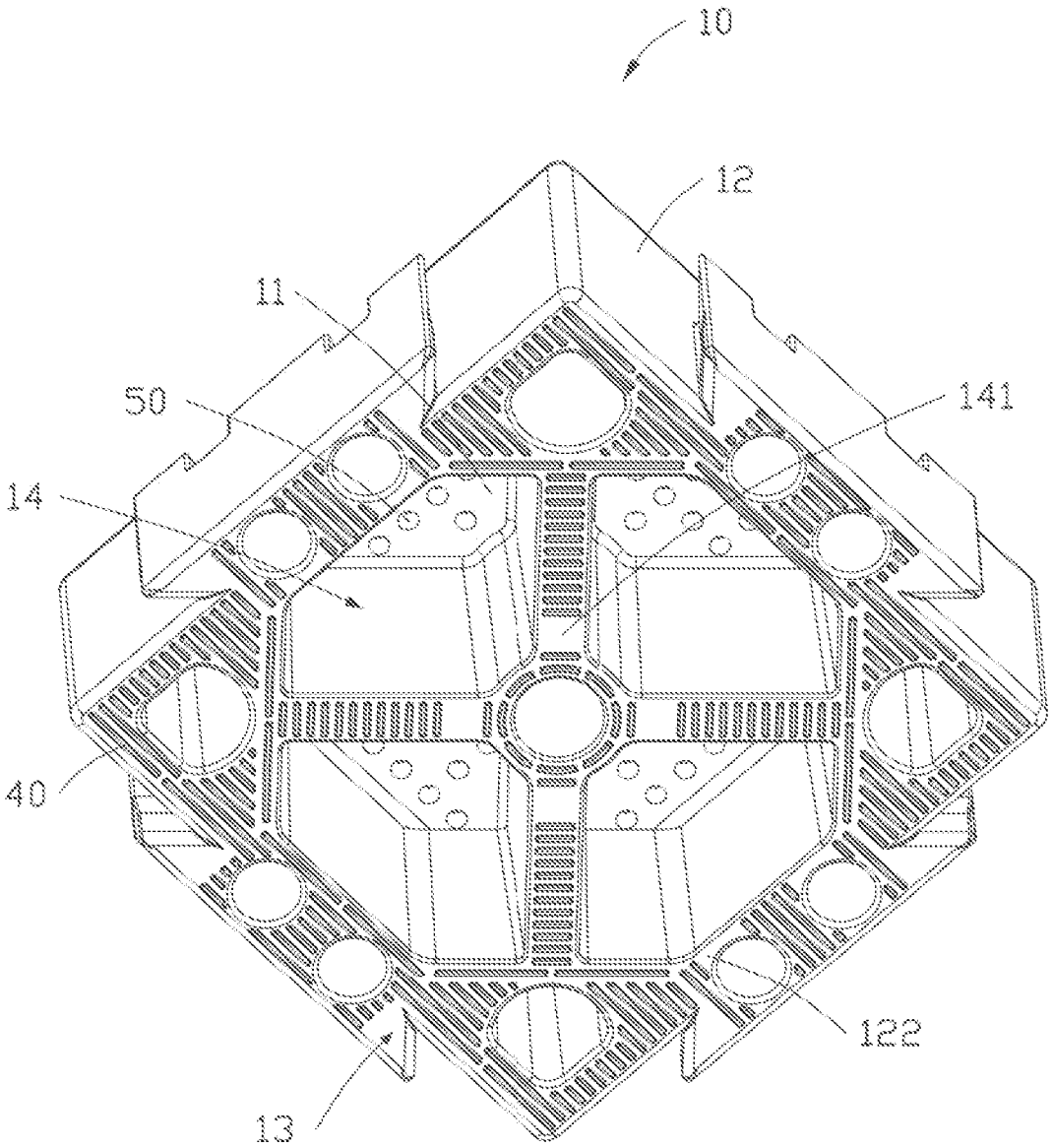
FIG. 6 illustrates another isometric view of the protruding brick according to one embodiment of the present disclosure.

Referring to FIG. 2 to FIG. 6, a protruding brick 10 will be described according to one embodiment of the present disclosure. As shown in FIG. 2, the protruding brick 10 comprises a top portion 11 and four sidewalls 12. The top portion 11 comprises a plurality of top anti-slip portion 30. Each of the sidewalls 12 is coupled to the top portions 11, and each angle between each of the sidewalls 12 and the top portion 11 is about 90 degrees. In addition, each of the sidewalls 12 comprises a tenon structure 13. The tenon structure 13 has a tenon front surface 131, a top surface 132, two side surfaces 133 (refer to FIG. 4) and a tenon structure bottom surface 134 (refer to FIG. 5). The tenon front surface 131 is coupled to the top surface 132, the two side surfaces 133, and the tenon structure bottom surface 134; the top surface 132, the two side surfaces 133, and the tenon structure bottom surface 134 are coupled to a sidewall surface 121 of the sidewall 12. Therefore, the tenon structure 13 is defined as a protrusion on the sidewall surface 121 of the protruding brick 10. Using the sidewall surface 121 as a reference, the angle between the sidewall surface 121 and the top surface 132 is less than 90 degrees; each angle between the sidewall surface 121 and each side surface 133 is less than 90 degrees as well; the angle between the tenon structure bottom surface 134 and the sidewall surface 121 is about 90 degrees. As shown in FIG. 3, the tenon front surface 131 is substantially parallel to the sidewall surface 121; as shown in FIGS. 3 and 5, the side surface 133 is substantially perpendicular to the top portion 11; as shown in FIG. 5, the tenon structure bottom surface 134 and a sidewall bottom surface 122 of the sidewall 12 are substantially coplanar and coupled to each other to increase the contact area between the protruding brick 10 and the ground. As shown in FIG. 6, the protruding brick 10 further comprises a support structure 14 arranged between the four sidewalls 12 and coupled thereto. More specifically, the support structure 14 is an "X"-shaped structure between the four sidewalls 12. A support structure bottom surface 141 of the support structure 14 and the sidewall bottom surface 122 of the sidewall 12 are substantially coplanar and coupled to each other, and the support structure 14 is extended upwardly from the support structure bottom surface 141 to be coupled to the top portion 11. The support structure bottom surface 141 of the support structure 14 and the sidewall bottom surface 122 of the sidewall 12 are in contact with the ground, and the support structure 14 and the sidewall 12 are both coupled to the top portion 11. Therefore, the load-bearing capacity of the top portion 11, as well as the overall structural strength of the protruding brick 10, is strengthened by the support structure 14.

As shown in FIG. 2, in one embodiment of the present disclosure, the top portion 11 of the protruding brick 10 comprises a plurality of top anti-slip portion 30. The top anti-slip portion 30 comprises a first anti-slip structure 31 and a second anti-slip structure 32. In one embodiment of the present disclosure, the first anti-slip structure 31 and the second anti-slip structure 32 are protrusions formed on the up facing surface of the top portion 11. The number of the first anti-slip structure 31 is greater than that of the second anti-slip structure 32, and the volume of the first anti-slip structure 31 is larger than that of the second anti-slip structure 32. The top anti-slip portion 30 increases the friction between the protrusion brick 10 and the object that it bears, for example, preventing pedestrians from slipping and vehicles from skidding.

As shown in FIG. 6, in one embodiment of the present disclosure, the protruding brick 10 further comprises a plurality of drainage holes 50 provided on the top portion 11, and the drainage holes 50 penetrate through the top portion 11, so liquids such as rainwater can pass through the top portion 11 and reach below the protruding brick 10. In another embodiment of the present disclosure, the bottom surface of the protruding 10 is formed by coupling of the sidewall bottom surfaces 122 of the four sidewalls 12, the tenon structure bottom surface 134 of the tenon structure 13 and the support structure bottom surface 141 of the support structure 14. In addition, the protruding brick 10 also comprises a plurality of bottom anti-slip portion 40 provided on the bottom surface thereof. More specifically, the sidewall bottom surface 122, the tenon structure bottom surface 134, and the support structure bottom surface 141 each comprises a plurality of bottom anti-slip portions 40. The bottom anti-slip portions 40 are protrusions on the bottom surface of the protruding brick 10 and configured to increase the friction between the ground and the protruding brick 10, so that the relative position of the protruding brick 10 and the ground can be more stably maintained. Furthermore, since the bottom anti-slip portion 40 is a protruding structure, there is a gap between the protruding brick 10 and the ground (see the partial enlargement 4-1 in FIG. 4), hence beneficial for liquid drainage of the protruding brick 10.

Figure 7:
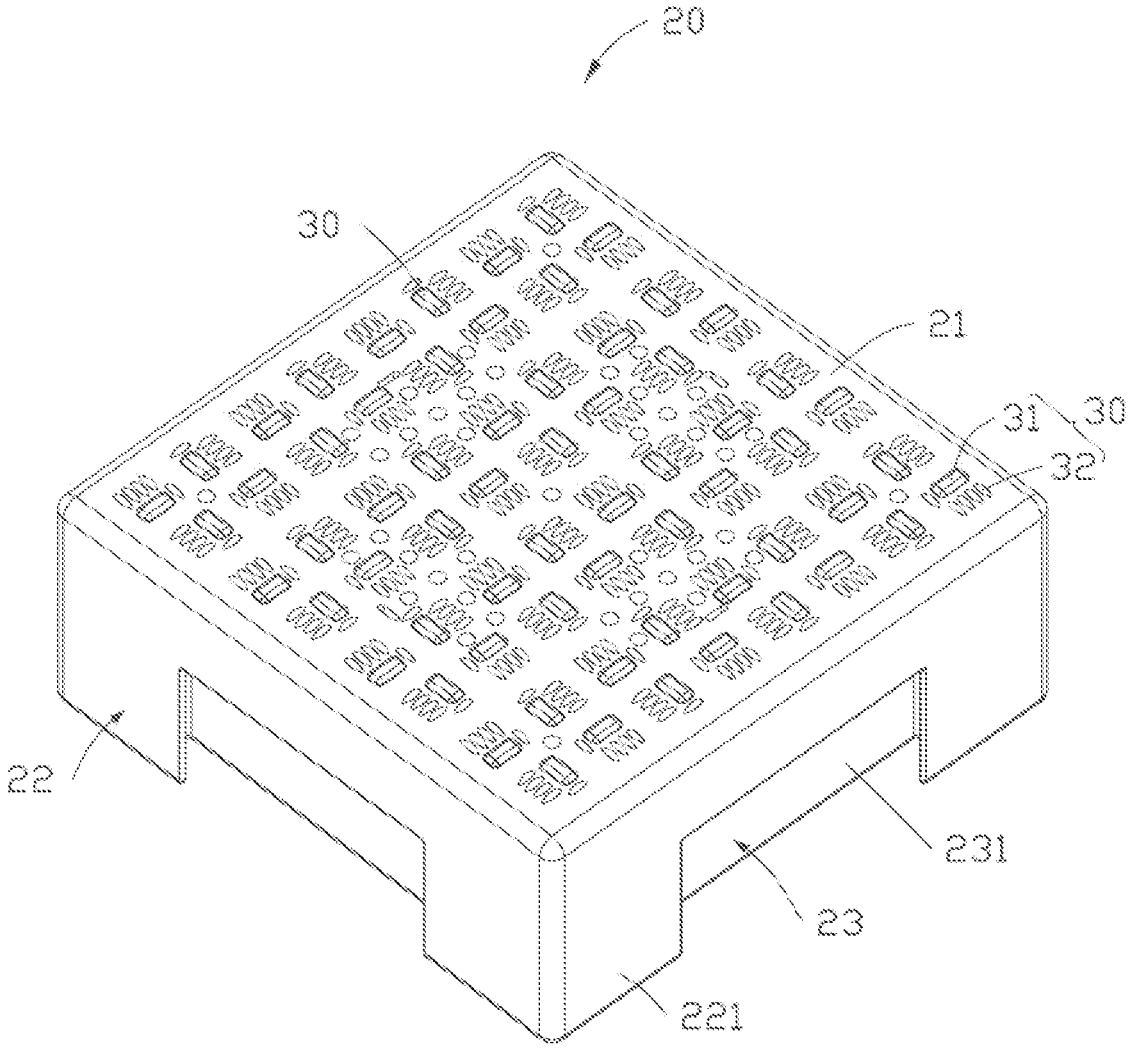
FIG. 7 illustrates an isometric view of a recessing brick according to one embodiment of the present disclosure.
Figure 8:
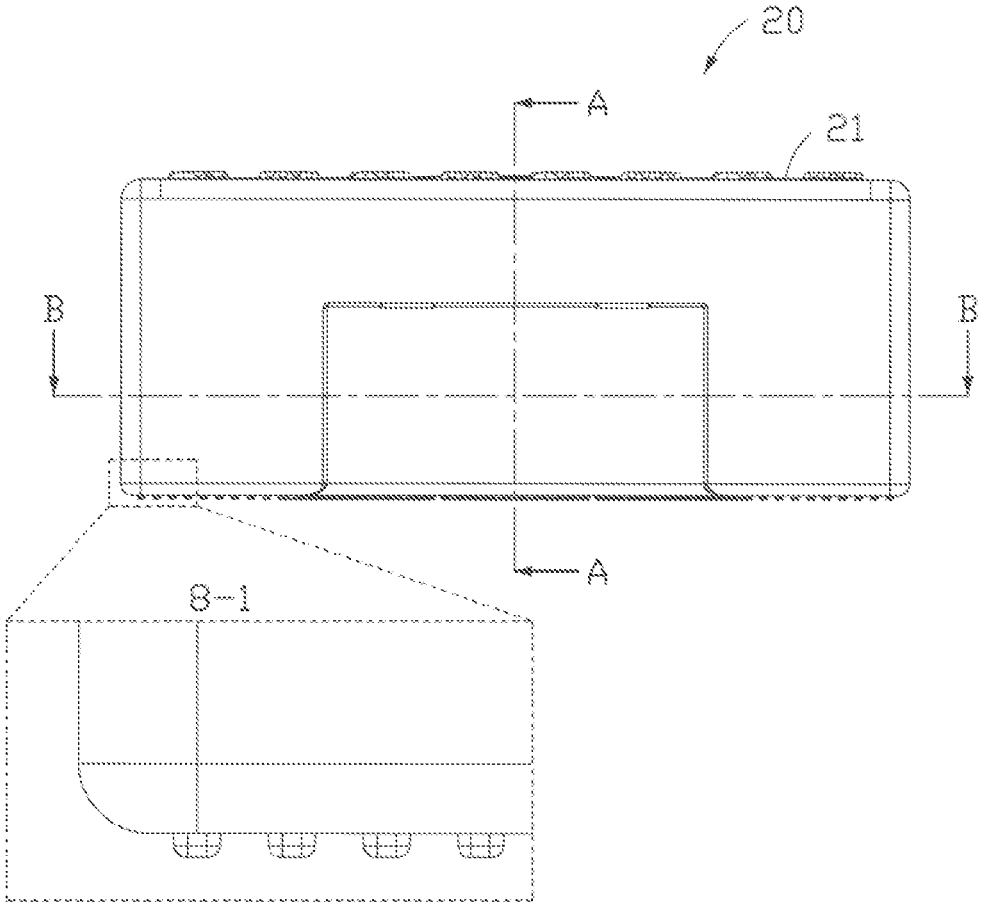
FIG. 8 illustrates a side view of the recessing brick according to one embodiment of the present disclosure.
Figure 9:
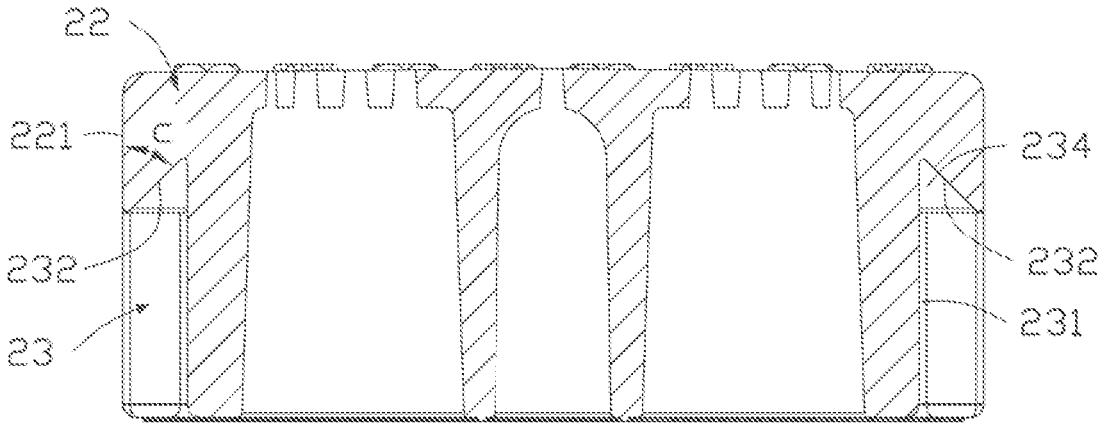
FIG. 9 illustrates a A-A cross sectional view of the recessing brick according to one embodiment of the present disclosure.
Figure 10:
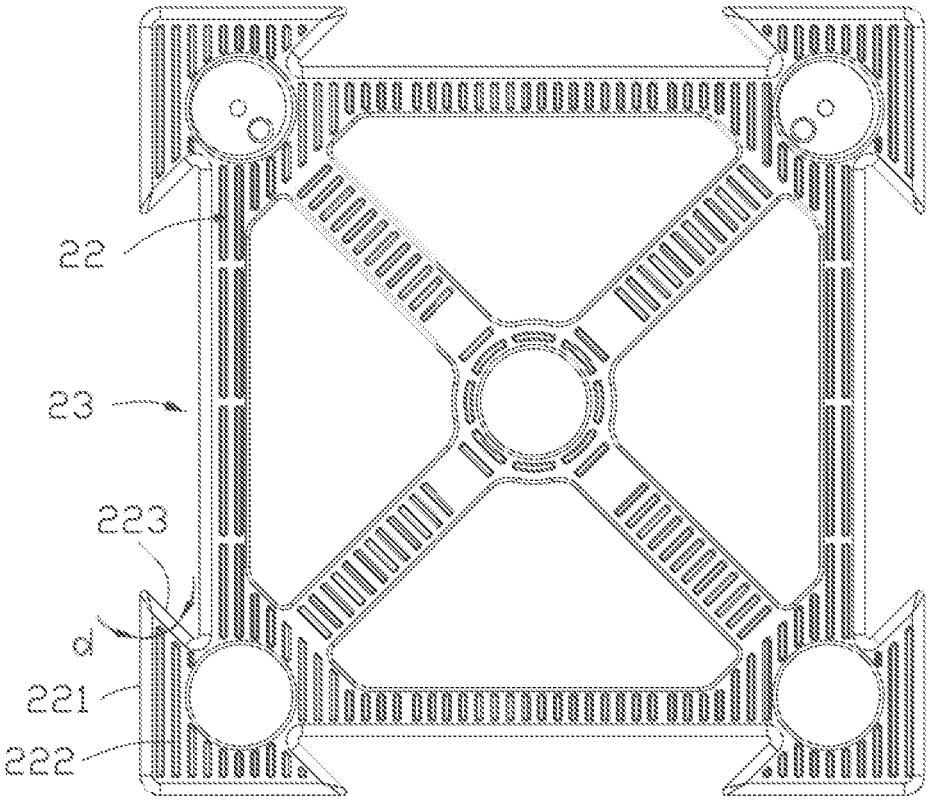
FIG. 10 illustrates a B-B cross sectional view of the recessing brick according to one embodiment of the present disclosure.
Figure 11:
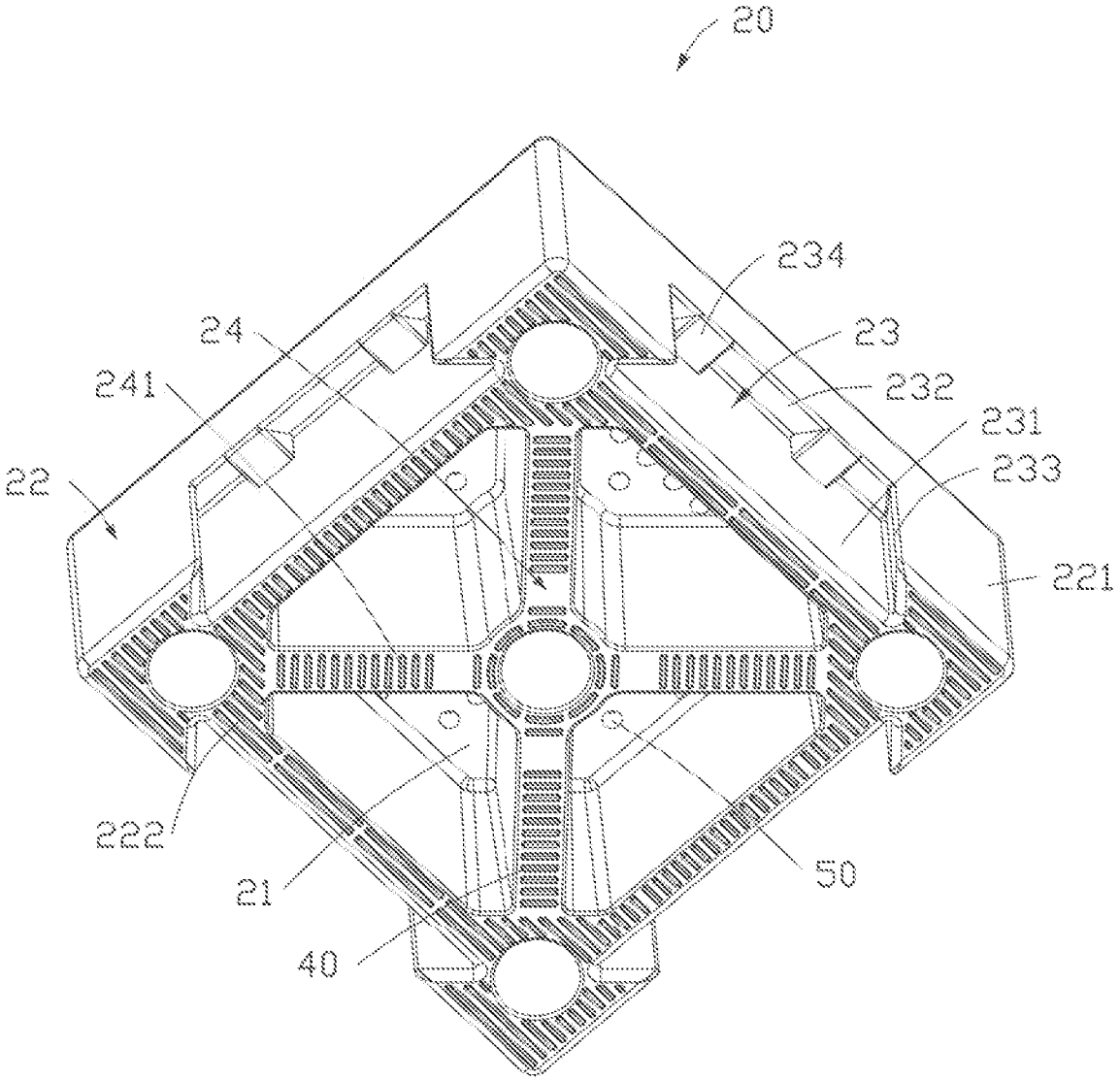
FIG. 11 illustrates another isometric view of the recessing brick according to one embodiment of the present disclosure.

Referring to FIGS. 7 to 11, the recessing brick 20 according to one embodiment of the present disclosure will be described in detail below. The recessing brick 20, which is a block, comprises a top portion 21 and four sidewalls 22, and the top portion 21 has a plurality of top anti-slip portion 30. Each sidewall 22 is coupled to the top portion 21, and each angle between each of the sidewalls 22 and the top portion 21 is about 90 degrees. In addition, each sidewall 22 has a mortise structure 23 which comprises a mortise front surface 231, an inner top surface 232, and two inner sides surface 233 (see FIGS. 10 and 11 for details). The mortise front surface 231 is coupled to the inner top surface 232 and the two inner side surfaces 233, and the inner top surface 232 and the two inner side surfaces 233 are coupled to a sidewall surface 221 of the sidewall 22. Therefore, the mortise structure 23 is defined as a depression on the sidewall surface 221 of the recessing brick 20. The angle between the inner top surface 232 and the sidewall surface 221 is less than 90 degrees, and each angle between the sidewall surface 221 and each inner side surface 233 and is less than 90 degrees as well. As shown in FIG. 11, the mortise front surface 231 and the sidewall surface 221 are substantially parallel; as shown in FIGS. 8 and 10, the inner side surface 233 is substantially perpendicular to the top 21. As shown in FIG. 11, the recessing brick 20 further comprises a support structure 24 arranged between the four sidewalls 22 and coupled thereto. More specifically, the support structure 24 is an "X"-shaped structure between the four sidewalls 22. A support structure bottom surface 241 of the support structure 24 and the sidewall bottom surface 222 of the sidewall 22 are substantially coplanar and coupled to each other, and the support structure 24 is extended upwardly from the support structure bottom surface 241 to be coupled to the top portion 21. The support structure bottom surface 241 of the support structure 24 and the sidewall bottom surface 222 of the sidewall 22 are in contact with the ground, and the support structure 24 and the sidewall 22 are both coupled to the top portion 21. Therefore, the load-bearing capacity of the top portion 21 (as well as the overall structural strength of the recessing brick 20) may be strengthened by the support structure 24.

As shown in FIG. 7, in one embodiment of the present disclosure, the top portion 21 of the recessing brick 20 has a plurality of top anti-slip portions 30, and each top anti-slip portion 30 comprises a first anti-slip structure 31 and a second anti-slip structure 32. In one embodiment of the present disclosure, the first anti-slip structure 31 and the second anti-slip structure 32 are protrusions formed on up facing surface of the top portion 21. The number of the first anti-slip structure 31 is greater than that of the second anti-slip structure 32, and the volume of the first anti-slip structure 31 is larger than that of the second anti-slip structure 32. The top anti-slip portion 30 increases the friction between the recessing brick 20 and the object that it bears, for example, preventing pedestrians from slipping and vehicles from skidding.

As shown in FIG. 11, in one embodiment of the present disclosure, the recessing brick 20 comprises a plurality of drainage holes 50 provided on the top portion 21, and the drainage holes 50 penetrate the top portion 21 so liquids such as rainwater can pass through the top portion 21 and reach below the recessing brick 20. In another embodiment of the present invention, the bottom surface of the recessing brick 20 is formed by coupling of the sidewall bottom surfaces 222 of the four sidewalls 22 and the support structure bottom surface 241 of the support structure 24. In addition, the recessing brick 20 further comprises a plurality of bottom anti-slip portions 40 provided on the bottom surface thereof. More specifically, the sidewall bottom surfaces 222 and the support structure bottom surface 241 each comprises a plurality of bottom anti-slip portions 40. The bottom anti-slip portions 40 are protrusions on the bottom surface of the recessing brick 20 and configured to increase friction between the ground and recessing brick 20, so that the relative position of the recessing brick 20 and the ground can be more stable. In addition, since the bottom anti-slip portion 40 is a protruding structure, there is a gap between the recessing brick 20 and the ground (see the partial enlargement 8-1 in FIG. 8), hence beneficial for liquid drainage of the recessing brick 20.

The protruding brick 10 shown in FIGS. 2 to 6 and the recessing brick 20 shown in FIGS. 7 to 11 can be assembled into the interlocking paving brick assembly 1 shown in FIG. 1. In one embodiment of the present disclosure, as shown in FIGS. 3 and 4, the tenon structure 13 of the protruding brick 10 and the corresponding sidewall surface 121 collaboratively form an angle a and an angle b that are both less than 90 degrees. Particularly, in the illustrated embodiment, angle a is defined by the top surface 132 of the tenon structure 13 and the corresponding sidewall surface 121, while angle b is defined by the side surface 133 of the tenon structure 13 and the corresponding sidewall surface 121.) Referring to FIGS. 9 and 10, where FIG. 9 and FIG. 10 are A-A and B-B cross-sectional views of FIG. 8, respectively. As shown in FIGS. 9 and 10, the mortise structure 23 of the recessing brick 20 and the corresponding sidewall surface 221 collaboratively form an angle c and an angle d that are both less than 90 degree. Particularly, as shown in the instant example, angle c is defined by the inner top surface 232 of the mortise structure 23 and the corresponding sidewall surface 221, and the angle d is defined by the inner side surface 233 of the mortise structure 23 and the corresponding sidewall surface 221. The angle a of the protruding brick 10 is equal to the angle c of the recessing brick 20; the angle b of the protruding brick 10 is equal to the angle d of the recessing brick 20. Therefore, the protruding brick 10 and the recessing brick 20 can be closely integrated with each other when they are assembled together.

In one embodiment of the present disclosure, the material of the interlocking paving brick assembly 1 may comprise polyethylene (PE), calcium carbonate ($CaCO_3$), polypropylene (PP), and paper fiber. The following are three examples of the raw material weight ratios: 1. 55-75% PE and 25-45% $CaCO_3$; 2. 55-70% PE, 15-20% PP and 15-25% $CaCO_3$; 3. 55-65% PE, 10-20% PP, 15-20% $CaCO_3$ and 3-8% paper fiber, among which the compression resistance of various ratios is from low to high according to listed order.

As shown in FIG. 4, in one embodiment of the present disclosure, the side surface 133 has a protrusion 136 at one end closer to the tenon structure bottom surface 134. When a protruding brick 10 and a recessing brick 20 are assembled into an interlocking paving brick assembly 1, the protrusion 136 is configured to facilitate tighter engagement therebetween. The length L1 of the protrusion 136 is less than the length L2 of the side surface 133 (e.g., L1 is shown to be less than one-half of L2), hence the assembly resistance and tightness are increased by the protrusion 136 after the tenon structure 13 is vertically overlapped with the mortise structure 23 by one-half of L2 upon the protruding brick 10 and the recessing brick 20 engaging with each other, and the protrusion 136 will not make assembly difficult as such. In another embodiment of the present disclosure, the distance between the upper ends of the two side surfaces 133 of the tenon structure 13 is less than the distance between the lower ends, so that a progressive resistance and tightness can be provided between the tenon structure 13 of the protruding brick 10 and the mortise structures 23 of the recessing bricks 20 upon coupling with each other. In another embodiment of the present disclosure, the same concept can also be applied to the inner sides 233 of the mortise structure 23 of the recessing brick 20, for example, the distance between the upper ends can be less than that between the lower ends of the two inner sides 233.

In one embodiment of the present disclosure, as shown in FIGS. 2 and 3, the tenon structure 13 of the protruding brick 10 comprises at least one sub-mortise structure 135 arranged between the top surface 132 and the tenon front surface 131. The sub-mortise structure 135 is a depression on the top surface 132 of the tenon structure 13, and the depression extends laterally from the tenon front surface 131 toward the sidewall surface 121 to define the sub-mortise structure 135. As shown in FIGS. 9 and 11, the mortise structure 23 of the recessing brick 20 comprises at least one sub-tenon structure 234 arranged between the mortise front surface 231 and the inner top surface 232. The sub-tenon structure 234 is a protrusion on the inner top surface 232 of the mortise structure 23, and the protrusion extends laterally from the mortise front surface 231 toward the sidewall surface 221 to define the sub-tenon structure 234. The shapes of the sub-mortise structure 135 and the sub-tenon structure 234 match each other. Therefore, the sub-mortise structure 135 can be fit to the sub-tenon structure 234 when the protruding brick 10 is fit to the recessing brick 20 by the tenon structure 13 and the mortise structure 23 thereof, respectively, to form the interlocking paving brick assembly 1 in FIG. 1, and the stability between the tenon structure 13 and the mortise structure 23 and the overall torsion resistance of the interlocking paving brick assembly 1 can be improved. It should be noted that the width of the sub-mortise structure 135 is less than that of the tenon structure 13; the width of the sub-tenon structure 234 is less than that of the mortise structure 23. In another embodiment of the present disclosure, each tenon structure 13 of the protruding brick 10 comprises a plurality of sub-mortise structures 135; each of the sub-mortise structures 23 of the recessing brick 20 comprises a plurality of the sub-tenon structures 234.

Figure 12:
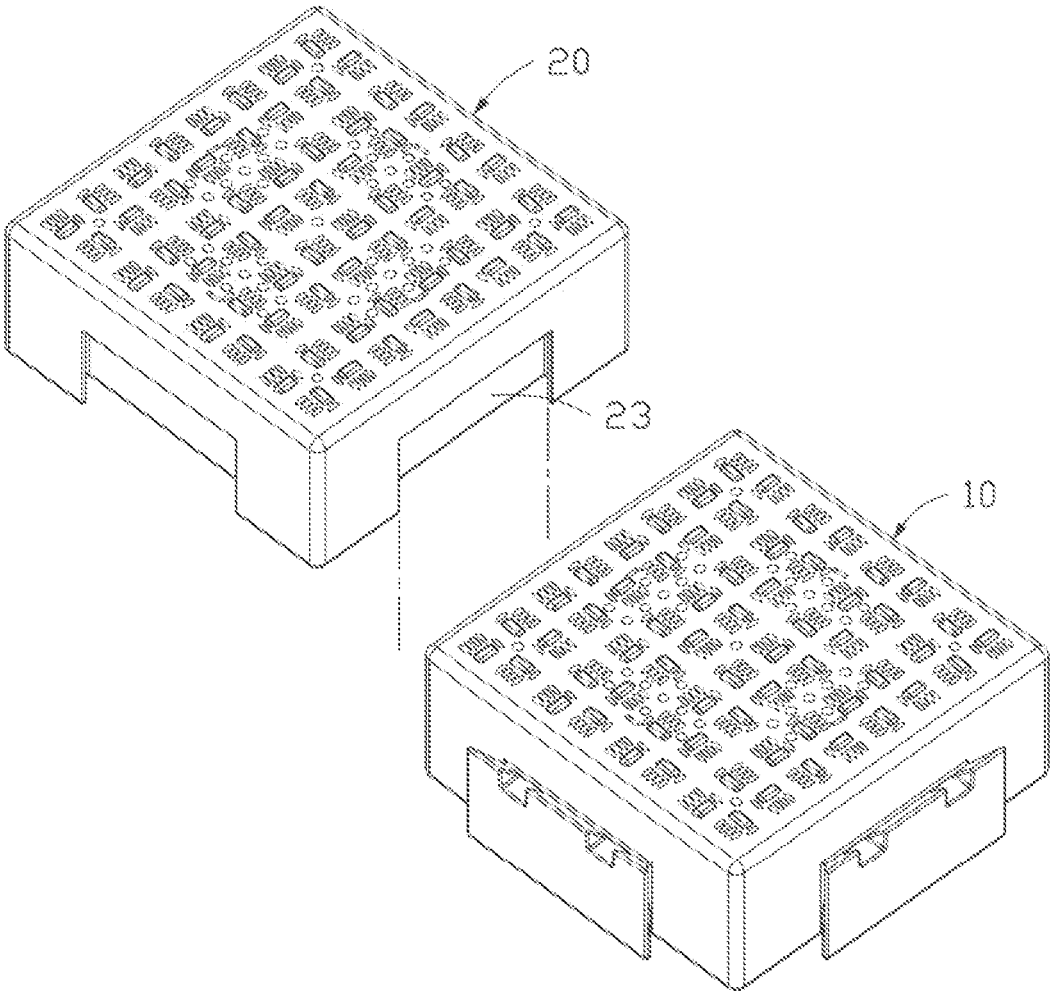
FIG. 12 illustrates an isometric view of a protruding brick and a recessing brick before assembly according to one embodiment of the present disclosure.
Figure 13:
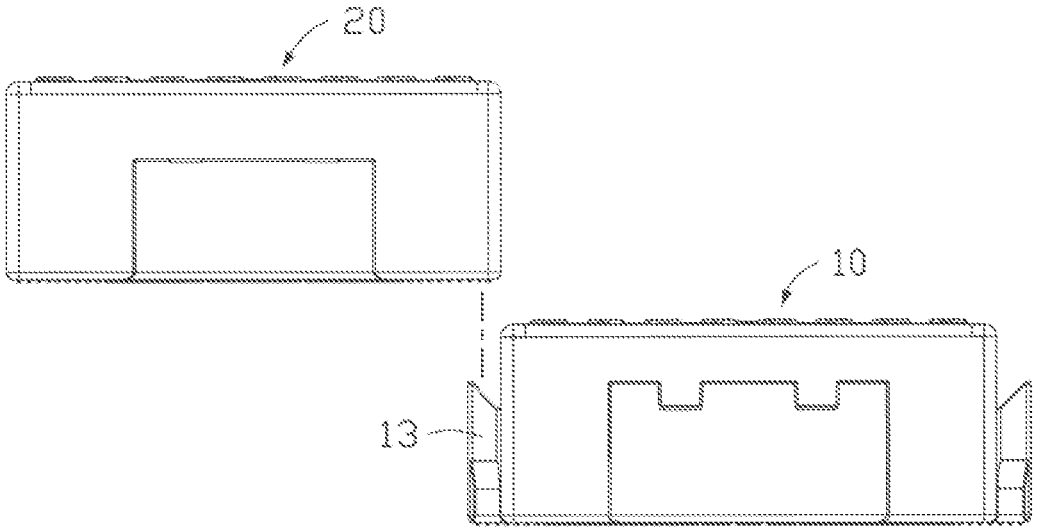
FIG. 13 illustrates a side view of the protruding brick and the recessing brick before assembly according to one embodiment of the present disclosure.
Figure 14:
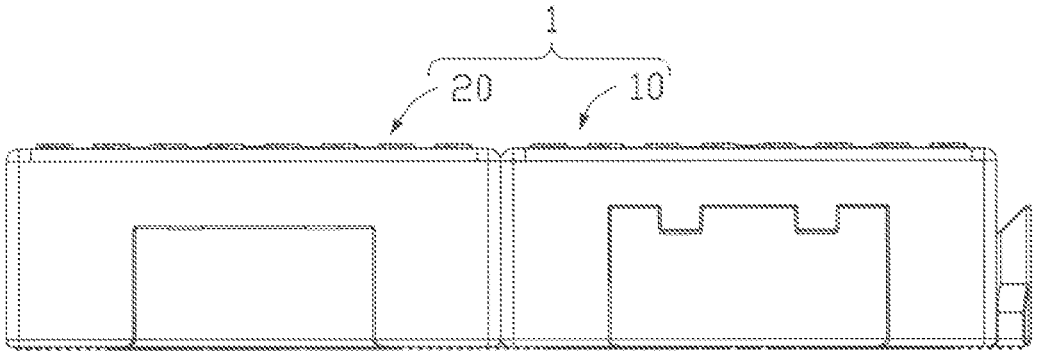
FIG. 14 illustrates a side view of the protruding brick and the recessing brick after assembly according to one embodiment of the present disclosure.

As shown in FIGS. 12 to 14, in one embodiment of the present disclosure, an assembly method of the interlocking paving brick assembly 1 is disclosed: in FIG. 12 and FIG. 13, vertically aligning the mortise structure 23 of the recessing brick 20 with the tenon structure 13 of the protruding brick 10; in FIG. 14, vertically clamping the recessing brick 20 to the protruding brick 10 from top to down until the top portion 21 of the recessing brick 20 is leveled with the top portion 11 of the protruding brick 10.

Figure 15:
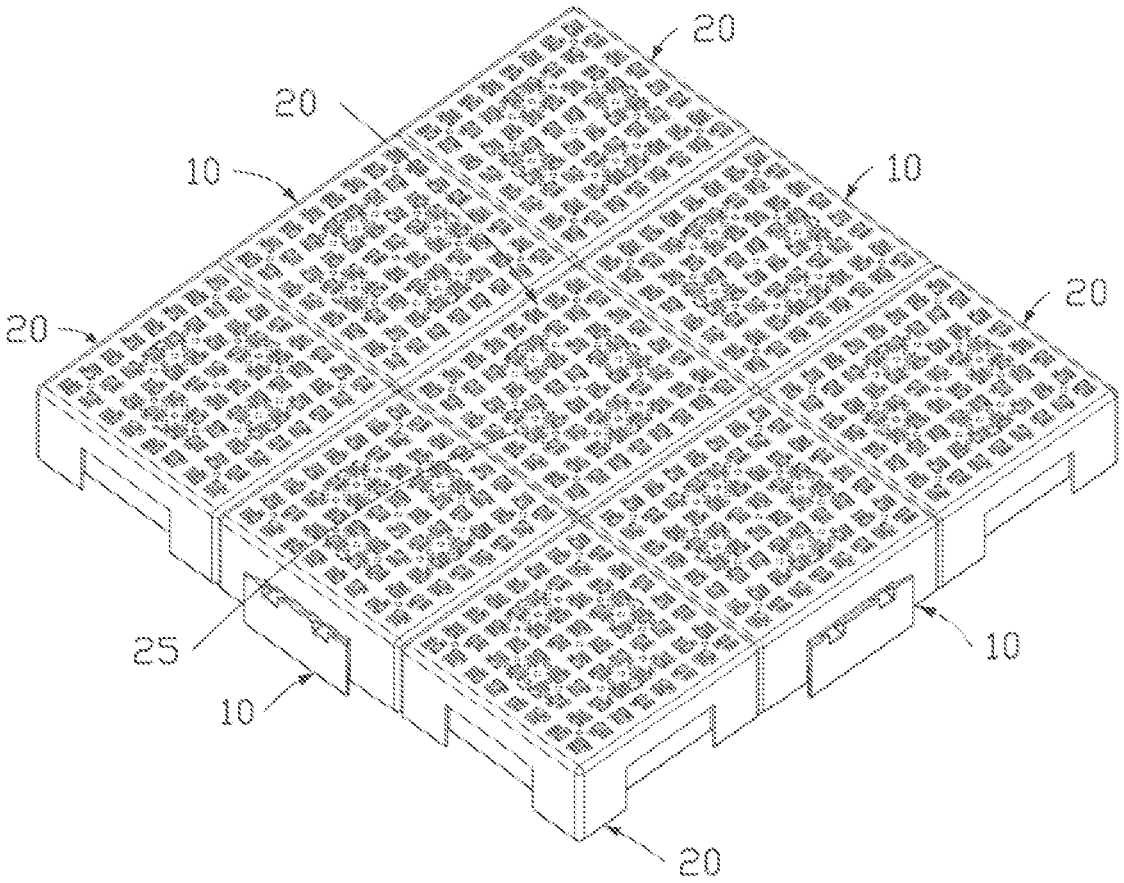
FIG. 15 illustrates an isometric view of multiple interlocking paving brick assembly according to one embodiment of the present disclosure.
Figure 16:
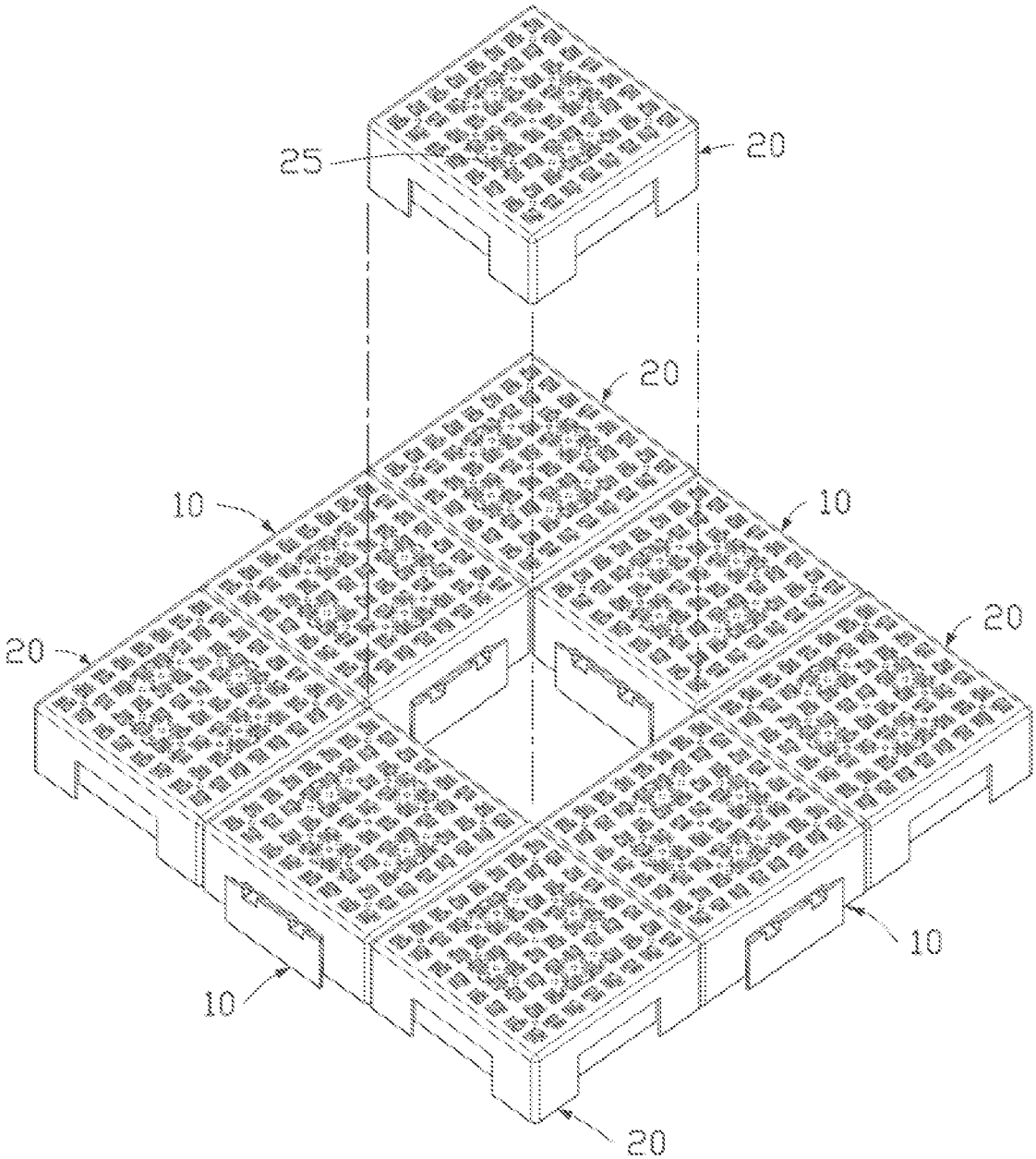
FIG. 16 illustrates an isometric view of disassembling of multiple interlocking paving brick assembly according to one embodiment of the present disclosure.

As shown in FIG. 15, in one embodiment of the present disclosure, a plurality of protruding brick 10 and a plurality of recessing brick 20 can be assembled together in an alternating manner according to the aforementioned assembly method, and each adjacent brick is tightly engaged to another and the top portions of the bricks are flush as such. If a daily maintenance or temporary repair of a damaged brick is required, the tight engagement and flush top portions of the bricks leaves no point of application. The recessing brick 20 further comprises at least one tool hole 25 through which a tool can pass. When the recessing brick 20 is to be removed from the multiple interlocking paving brick assemblies as shown in FIG. 16, one can apply upward force thereto through the tool in the tool hole 25.

The embodiments shown and described above are only examples. Many details are often found in this field of art thus many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An interlocking paving brick assembly comprising:

a protruding brick having a block shape, the protruding brick comprising a first top portion and four first sidewalls, wherein each of the four first sidewalls is substantially perpendicular to the first top portion and comprises a first sidewall surface and a tenon structure, and each of the tenon structures comprises a side surface and a top surface, wherein the top surface of the tenon structure and its corresponding first sidewall surface define an angle a, and the side surface of the tenon structure and its corresponding first sidewall surface define an angle b; and a recessing brick having the block shape, the recessing brick comprising a second top portion and four second sidewalls, wherein each of the four second sidewalls is substantially perpendicular to the second top portion and comprises a second sidewall surface and a mortise structure, and each of the mortise structures comprises an inner side surface and an inner top surface, wherein the inner top surface of the mortise structure and its corresponding second sidewall surface define an angle c, and the inner side surface of the mortise structure and its corresponding sidewall surface define an angle d, wherein the tenon structures of the protruding brick and the mortise structures of the recessing brick are structurally complementary to each other, whereby the protruding brick interlocks with the recessing brick upon coupling of the tenon structures and the mortise structures to form the interlocking paving brick assembly, wherein the angle a and angle b of the protruding brick is equal to the angle c and angle d of the recessing brick, respectively.

2. The interlocking paving brick assembly of claim 1, wherein each of the tenon structures further comprises a tenon structure bottom surface, and each of the side structures of the tenon structures has a protrusion at one end closer to the tenon structure bottom surface, a first length of the protrusion is less than a second length of the side surface, and wherein the protrusion is configured to facilitate tighter engagement between the protruding brick and the recessing brick when the protruding brick and the recessing brick are assembled to form the interlocking paving brick assembly.

3. The interlocking paving brick assembly of claim 1, wherein the tenon structure of the first sidewall further comprises a tenon front surface and a sub-mortise structure which is arranged between the top surface and the tenon front surface, wherein the sub-mortise structure is a depression on the top surface, wherein the mortise structure of the second sidewall further comprises a mortise front surface and a sub-tenon structure which is arranged between the mortise front surface and the inner top surface, wherein the sub-tenon structure is a protrusion on the inner top surface, and wherein shapes of the sub-mortise structure and the sub-tenon structure match each other, whereby the sub-mortise structure fit into the sub-tenon structure when the protruding brick is fit into the recessing brick by the tenon structure and the mortise structure to form the interlocking paving brick assembly.

4. The interlocking paving brick assembly of claim 1, wherein raw material weight ratio of the interlocking paving brick assembly is 55-75% PE and 25-45% $CaCO_3$.

5. The interlocking paving brick assembly of claim 1, wherein raw material weight ratio of the interlocking paving brick assembly is 55-70% PE, 15-20% PP and 15-25% $CaCO_3$.

6. The interlocking paving brick assembly of claim 1, wherein raw material weight ratio of the interlocking paving brick assembly is 55-65% PE, 10-20% PP, 15-20% $CaCO_3$ and 3-8% paper fiber.

7. The interlocking paving brick assembly of claim 1, wherein each of the tenon structures further comprises a tenon front surface and a tenon structure bottom surface, and the tenon front surface, the top surface, two of the side surfaces, and the tenon structure bottom surface form a protrusion that protrudes from the first sidewall surface of the first sidewall, wherein an angle between the top surface and the first sidewall surface, and between the side surface and the first sidewall surface, is less than 90 degrees, and wherein the tenon front surface is substantially parallel to the first sidewall surface, the two side surfaces are substantially perpendicular to the first top portion, and the tenon structure bottom surface is substantially coplanar with a first sidewall bottom surface of the first sidewall.

8. The interlocking paving brick assembly of claim 7, wherein the protruding brick further comprises a first support structure arranged between the four first sidewalls, and the first support structure is an "X"-shape structure, and wherein a first support structure bottom surface of the first support structure is substantially coplanar with the first sidewall bottom surface, and the first support structure is extended upwardly from the first support structure bottom surface to be coupled to the first top portion.

9. The interlocking paving brick assembly of claim 1, wherein the protruding brick further comprises a plurality of first bottom anti-slip portions which are protrusions on a bottom surface of the protruding brick.

10. The interlocking paving brick assembly of claim 1, wherein each of the mortise structures further comprises a mortise front surface, and the mortise front surface, the inner top surface, and two of the inner side surfaces form a depression on the second sidewall surface of the second sidewall, wherein an angle between the inner top surface and the second sidewall surface, and between the inner side surfaces and the second sidewall surface, is less than 90 degrees, and wherein the mortise front surface is substantially parallel to the second sidewall surface, and the inner side surfaces are substantially perpendicular to the second top portion.

11. The interlocking paving brick assembly of claim 10, wherein the recessing brick further comprises a second support structure arranged between the four second sidewalls, and the second support structure is an "X"-shape structure, and wherein a second support structure bottom surface of the second support structure is substantially coplanar with a second sidewall bottom surface of the second sidewall, and the second support structure is extended upwardly from the second support structure bottom surface to be coupled to the second top portion.

12. The interlocking paving brick assembly of claim 11, wherein the recessing brick further comprises a plurality of second bottom anti-slip portions which are protrusions on a bottom surface of the recessing brick.

13. The interlocking paving brick assembly of claim 1, wherein the recessing brick further comprises at least one tool hole through which a tool is passable, whereby the recessing brick is to be removed from the interlocking paving brick assembly when an upward force is applied by the tool in the tool hole.

* * * * *